US006712689B2

(12) United States Patent
Clarkson et al.

(10) Patent No.: US 6,712,689 B2
(45) Date of Patent: Mar. 30, 2004

(54) COCKPIT VENT FOR A POWER BOAT

(76) Inventors: James Clarkson, 3111 St. Jude Dr., Waterford, MI (US) 48329; Emerson Wesley Ritchie, 150 SW. 6th Ter., Boca Raton, FL (US) 33486

( * ) Notice: Subject to any disclaimer, the term of this patent is extended or adjusted under 35 U.S.C. 154(b) by 0 days.

(21) Appl. No.: 10/206,680

(22) Filed: Jul. 27, 2002

(65) Prior Publication Data

US 2004/0018811 A1 Jan. 29, 2004

(51) Int. Cl.[7] ..... B63J 2/02
(52) U.S. Cl. ..... 454/78; 454/138; 114/211
(58) Field of Search ..... 454/78, 79, 82, 454/138; 114/211, 212

(56) References Cited

U.S. PATENT DOCUMENTS 877,655 A 1/1908 Low
2,756,664 A * 7/1956 McCuen ..... 454/138
3,013,483 A 12/1961 Knight
3,018,784 A 1/1962 Buxman
4,970,946 A 11/1990 Ivey
5,339,759 A 8/1994 Peabody
5,709,163 A 1/1998 Livingston

* cited by examiner

*Primary Examiner*—Gregory A. Wilson
(74) *Attorney, Agent, or Firm*—Mitchell M. Musial, II

(57) ABSTRACT

A ventilation system and method for venting a cockpit of a power boat is disclosed herein. The ventilation system comprises a windshield extending from a foredeck of the powerboat, a cockpit cover at least covering the cockpit and a frame. A cockpit vent comprises a frame defining at least one aperature for introducing ambient air into the cockpit. The frame is disposed between the windshield and cockpit cover and includes a windshield engagement member and a cover engagement member spaced from the windshield engagement member.

22 Claims, 6 Drawing Sheets

COCKPIT VENT FOR A POWER BOAT

FIELD OF THE INVENTION

The present invention relates to ventilation systems for marine craft, and more specifically, to ventilation systems for power boats having a cockpit.

BACKGROUND OF THE INVENTION

Boats have been used for centuries as a means of transportation across waterways, to harvest fish from the waters, and more recently for pleasure. Power boats, boats with an on board power source, are typically powered by an internal combustion engine. A common concern regarding power boats is exhaust fumes and fuel vapor from the combustion engine tend to accumulate in the cockpit.

Power boats are commonly provided with a cover over at least part of the cockpit to provide protection from the sun and weather. The cockpit cover is typically formed of canvas or a rigid member such as fiberglass. A canvas cover is typically supported by a suitable frame mounted on the boat and windshield. A cockpit cover formed of a rigid member typically interfaces with a top sill of the windshield. Support for a rigid cockpit cover is typically inherent in the structure of the cover.

Power boats that are provided with a cockpit cover accumulate more exhaust fumes and fuel vapor than those without a cockpit cover. Furthermore, ventilation on hot days would also add comfort to those on board the power boat.

The art is replete with a variety of ventilation systems for marine craft. One such system requires significant modification to the foredeck. However, a ventilation system located at the foredeck would be susceptible to penetration from water splashing over the bow of the boat. Another system requires a customized cover. However, a ventilation system located on the cover would be susceptible to rain.

There exists a need in the art for a cockpit vent that will provide sufficient ventilation to the cockpit of a power boat. Furthermore, there exists a need in the art for a ventilation system that may be implemented without modification to the existing power boat. There further exists a need in the art for a ventilation system that it is significantly less susceptible to penetration from water and debris.

SUMMARY OF THE INVENTION

A cockpit vent for power boat having a cockpit, a windshield and a cockpit cover comprises a frame defining at least one aperture for introducing ambient air to the cockpit. The frame includes a windshield engagement member and a cover engagement member. The frame is disposed between the windshield and the cockpit cover. The windshield engagement member is attachable to a top sill of a boat windshield. The cover engagement member is spaced from the windshield engagement member and is attachable to the cockpit cover. A pair of side members may be disposed between end portions of the windshield engagement member and cover engagement member to interconnect the windshield engagement member and cover engagement member.

In an alternate embodiment, a cockpit ventilation system for power boat comprises a windshield extending from a foredeck of the power boat and a cockpit cover at least partially covering the cockpit. A frame defining at least one aperture for introducing ambient air into the cockpit, which includes a windshield support member and cover support member, is disposed between the windshield and cockpit cover. The windshield support member is attached to a top portion of the windshield and the cover support member is spaced from the windshield support member and is attached to the cockpit cover.

A method for venting a cockpit of a power boat having a cockpit, windshield and a cockpit cover comprises spacing a cover support member from a windshield support member. The windshield support member is attached to a top portion the windshield, thereby forming a vent having at least one aperture therebetween. The vent is positioned at an angle relative to a long axis of the power boat to allow an air to flow into the cockpit of the boat.

Further objects, features and advantages of the present invention will become apparent to those skilled in the art from analysis of the following written description, the accompanying drawings and the appended claims.

DESCRIPTION OF THE PREFERRED EMBODIMENT

Figure 1:
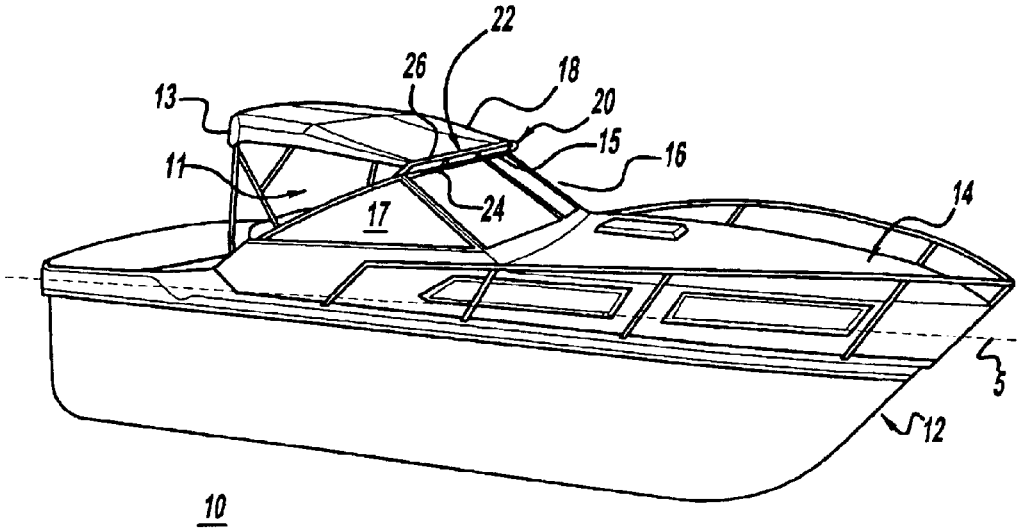
FIG. 1 is a perspective view of a power boat revealing a cockpit vent in accordance with a first embodiment of the present invention.

With initial reference now to FIG. 1, a perspective view of a power boat 10 revealing a cockpit vent 20 in accordance with a first embodiment of the present invention is shown. The boat includes a hull 12 having a foredeck 14 disposed thereon extending from the bow to about midway along the length of the boat 10. A rearwardly angled windshield 16 extends upward from the foredeck 14. A pair of side windows 17 extend rearward from the windshield 16 generally parallel to the side of the boat 10. The cockpit 13 is bounded by the windshield 16 and side windows 17. A cockpit cover 18 is supported by frame 11 and at least partially covers the cockpit 13. Although a soft cover 18, for example one made from canvas, is shown, the present invention is also intended to be applied to power boats having a rigid cover, made from, for example, fiberglass or the like. A typical cockpit cover 18 interfaces with or is securely attached to a top sill 15 of the windshield 16. The top sill 15 is attached to a top portion of the windshield 16.

A ventilation system 23 comprises the windshield 16, cockpit cover 18 and vent 20. The cockpit 13 of the power boat 10 is vented by spacing the cover engagement member 26 from the windshield engagement member 24, thereby forming an aperture 21 of the vent 20. The cover engagement member 26 may be a separate component or a cover support such as a forward portion 9 of the frame 13 or a forward portion of a rigid cover (not shown). The windshield engagement member 24 may be a separate component or a windshield support such as top sill 15. It is therefore contemplated to be within the scope of the present invention to form frame 22 from a windshield support member, such as top sill 15, and spacing a cover support member, such as the forward portion 9 of the frame 11, from the windshield support member to form at least one aperture 21. By forming the frame 22 from existing components, part cost and weight savings may be achieved. Furthermore, the frame 22 may also be at least partially formed from a forward portion of a rigid cockpit cover.

Figure 2A:
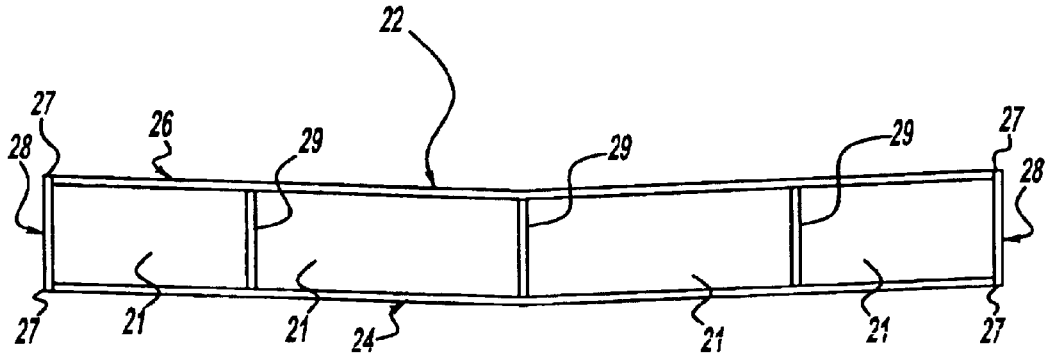
FIG. 2A is a plan view of a first embodiment of the vent according to the principles of the present invention.

Referring now also to FIG. 2A, another embodiment of the cockpit vent 20 of the present invention is shown comprising a frame 22 defining at least one aperture 21 for introducing ambient air into the cockpit 13. The frame 22 includes a windshield engagement member 24 and a cover engagement member 26. The frame 22 is disposed between the windshield 16 and the cockpit cover 18.

Windshield engagement member 24 is attachable to a top sill 15 of the windshield 16 by any suitable means known in the art, including, but not limited to, snaps, hook and loop type fastener devices, such as that sold under the trade mark VELCRO, one or more zippers, threaded fasteners, clamps, permanent attachment methods such as adhesives, rivets or welding. In the exemplary embodiment of FIG. 1, windshield engagement member 24 generally follows the contour of the top sill 15 of the windshield 16. In the preferred embodiment, the vent 20 is formed so as to blend with the styling of the boat 10.

Cover engagement member 26 is spaced from the windshield engagement member 24. The cover engagement member 26 is attachable to the cockpit cover 18 by any suitable means known in art, including, but not limited to, snaps, hook and loop type fastener devices, such as that sold under the trade mark VELCRO, one or more zippers, threaded fasteners, clamps, permanent attachment methods such as adhesives, rivets or welding. In a preferred embodiment, the cover engagement member 26 generally follows the contour of a front edge 19 of the cockpit cover 18.

Figure 2B:
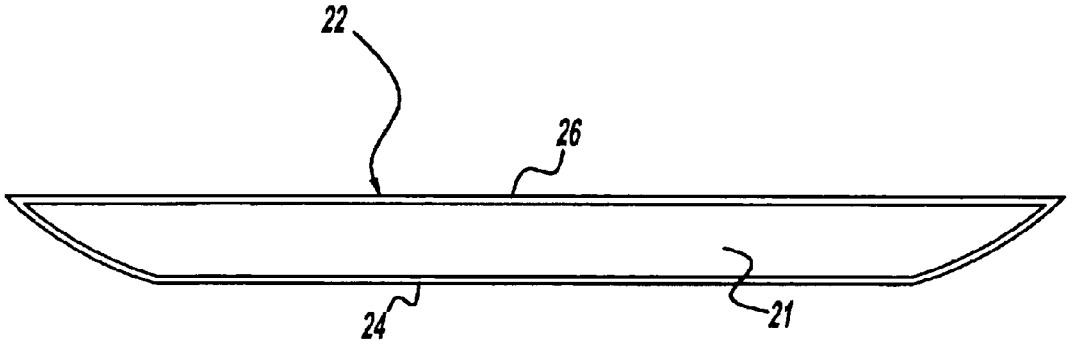
FIG. 2B is a plan view of a second embodiment of the vent according to the principles of the present invention.
Figure 2C:
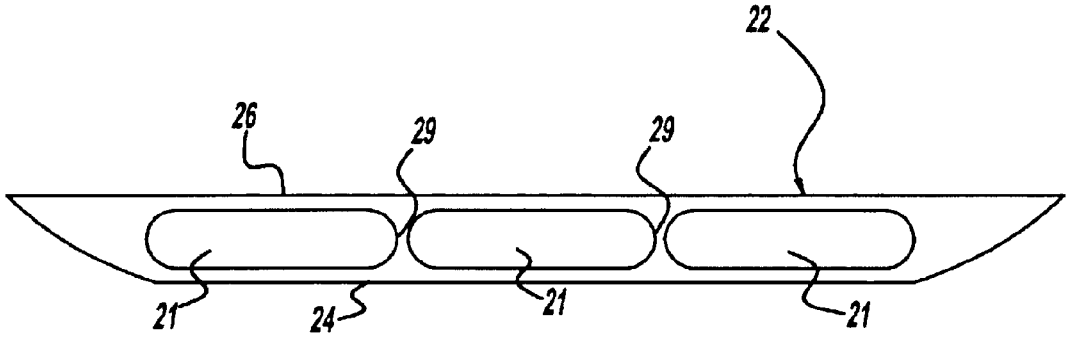
FIG. 2C is a plan view of a third embodiment of the vent according to the principles of the present invention.

The cockpit vent 20 may further comprise at least one support member 29 disposed between the windshield engagement member 24 and cover engagement member 26 for rigidly supporting the frame 22. A pair of side members 28 are disposed between end portions 27 of windshield engagement member 24 and cover engagement member 26, thereby interconnecting the windshield engagement member 24 and the cover engagement member 26. Alternatively, either one of the windshield engagement member 24 or cover engagement member 26 may be extended to eliminate the side members 28, as shown in FIG. 2B. In a third embodiment of the present invention, the frame 22 may be a unitary member as shown in FIG. 2C, and may incorporate at least one support member 29.

The frame 22 may be formed of any suitable material known in the art including, but not limited to, aluminum, stainless steel and high-strength plastic. The simplicity of the design of vent 20 allows for numerous manufacturing processes to be employed, including, but not limited to, extrusion, molding and forming.

Figure 3:
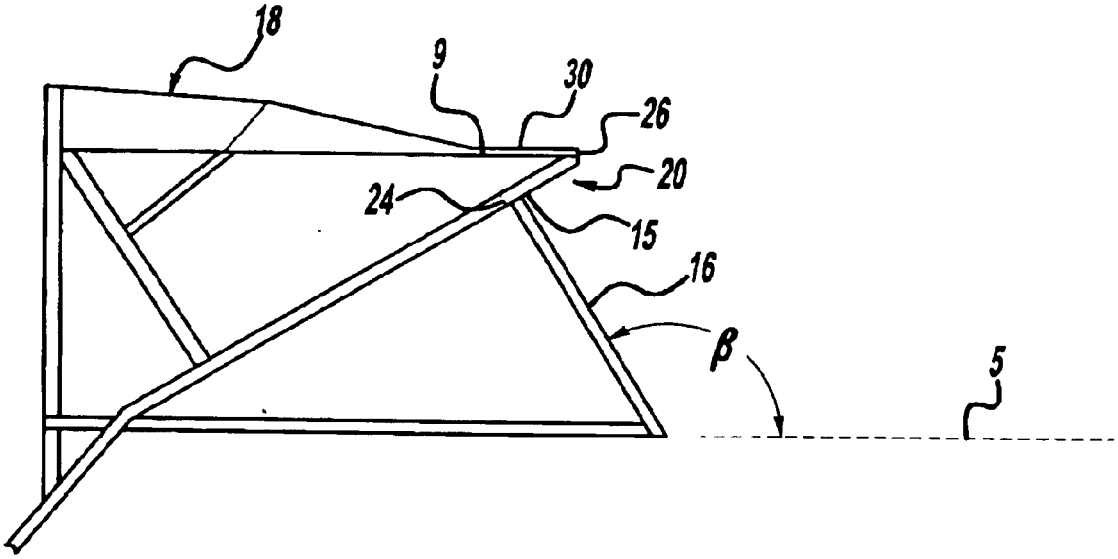
FIG. 3 is an enlarged partial side view of the power boat of FIG. 1 revealing an alternate embodiment of the cockpit vent of the present invention, further including a cover engagement member adapter.

Referring now to FIG. 3, an enlarged partial side view of the power boat 10 of FIG. 1 revealing the cockpit vent 20 of the present invention is shown further revealing a cover engagement member adapter 30 operatively disposed. The windshield 16 is angled rearwardly at an obtuse angle $\beta$ relative to a long axis 5 of the boat 10. When the boat 10 is in motion, air flows over the foredeck 14 and is deflected upward over the windshield 16 and, in the exemplary embodiment of FIG. 2, into the cockpit vent 20 of the present invention. The cover engagement member adapter 30 extends from the cover engagement member 26 to the cockpit cover 18. The adapter 30 allows the vent 20 of the present invention to be installed without modification to the existing windshield 16 or cockpit cover 18.

Figure 4:
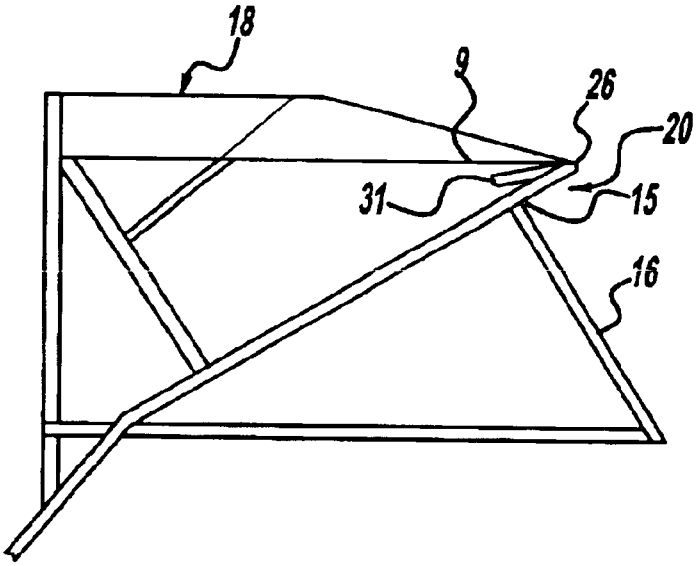
FIG. 4 is an enlarged partial side view of the power boat of FIG. 1 revealing an alternate embodiment of the cockpit vent of the present invention, further including an air deflector.

Referring now to FIG. 4 an enlarged partial side view of the power boat of FIG. 1 is shown revealing another embodiment of the cockpit vent 20 of the present invention, further including an air deflector 31. In the present embodiment, the deflector 31 extends inwardly from the cover engagement member 26 of the vent 20. The deflector 31 redirects ambient air introduced through the vent 20 away from the cover 18.

Figure 5:
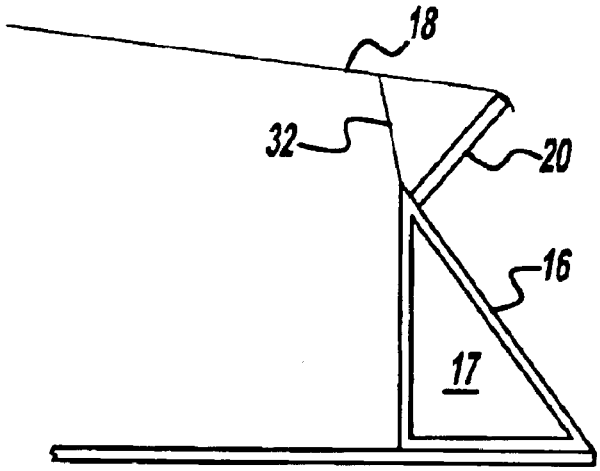
FIG. 5 is a partial side view of a power boat revealing an alternate embodiment of the cockpit vent of the present invention, further including an air dam.

Referring now to FIG. 5, a partial side view of a power boat 10 is shown revealing another embodiment of the cockpit vent 20 of the present invention, further including an air dam 32. In the present embodiment, the air dam 32 extends between the windshield engagement member 24 and one of either the cover engagement member 26 or the cover engagement member adapter 30. The air dam 32 is provided to halt the flow of ambient air introduced by the vent 20 into the cockpit 13. The air dam 32 is selectively engageable and may be engaged by employing any suitable means known the art, including, not limited to, zippers, snaps or hook and loop type fastener devices, such as that sold under the trade mark VELCRO.

Figure 6:
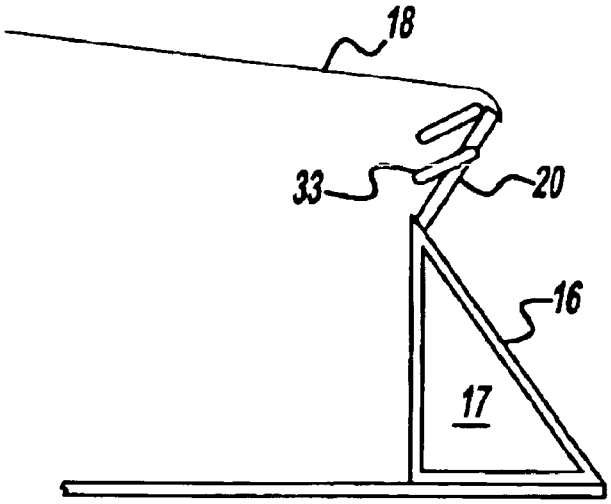
FIG. 6 is a partial side view of a power boat revealing an alternate embodiment of the cockpit vent of the present invention, further including a set of louvers.

Referring now to FIG. 6, a partial side view of a power boat 10 is shown, revealing another embodiment of the cockpit vent 20 of the present invention, further including a set of louvers 33. In the present embodiment, the louvers 33 extend between the windshield engagement member 24 and one of either the cover engagement member 26 or the cover engagement member adapter 30. The louvers 33 are provided for restricting the flow of ambient air introduced by the vent 20 into the cockpit 13. In one embodiment, the louvers 33 are selectively adjustable, by any suitable means know in the art, from an open position where airflow through said vent is maximized, to a closed position where the airflow through said vent 20 is halted.

Figure 7:
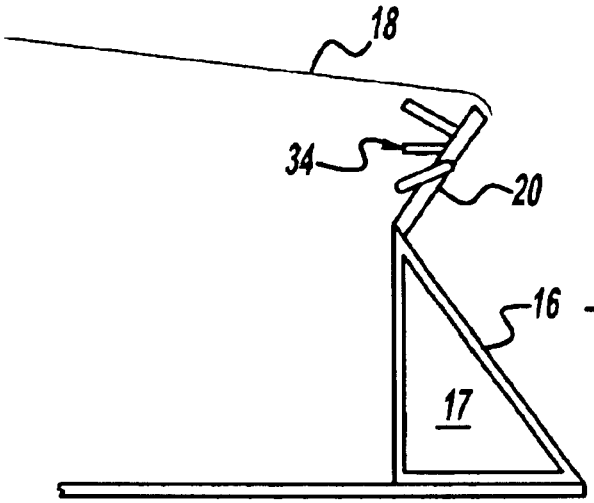
FIG. 7 is a partial side view of a power boat revealing an alternate embodiment of the cockpit vent of the present invention, further including a diffuser.

Referring now to FIG. 7, a partial side view of a power boat 10 is shown, revealing another embodiment of the cockpit vent 20 of the present invention, further including a diffuser 34. In the present embodiment, the diffuser 34 extends between the windshield engagement member 24 and one of either the cover engagement member 26 or a cover engagement member adapter 30. The diffuser 34 is provided to expand the flow of ambient air introduced by the vent 20 into the cockpit 13.

Figure 8A:
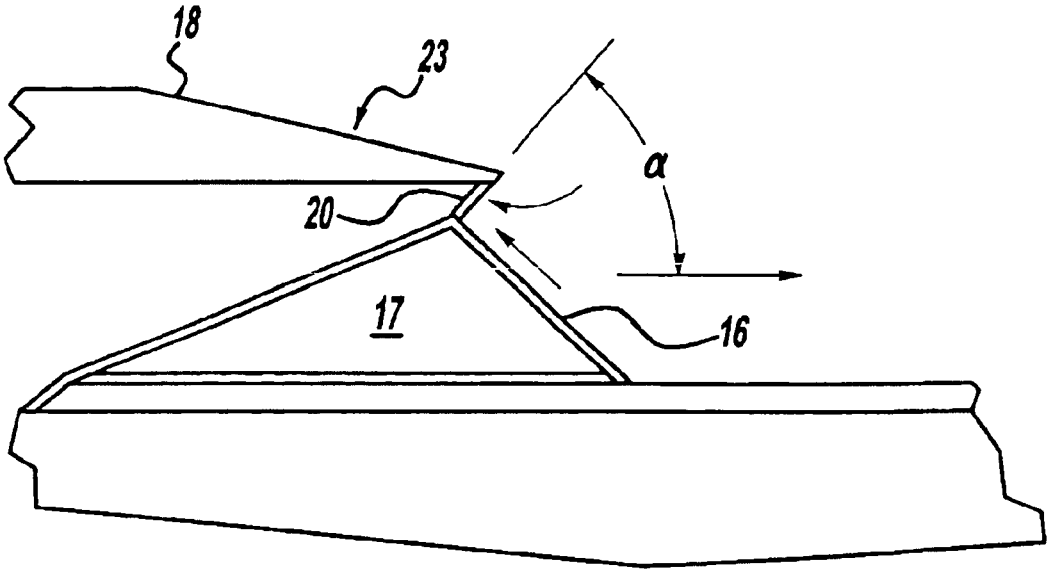
FIG. 8A is an enlarged partial side view of the power boat of FIG. 1 revealing the vent positioned at an acute angle relative to the long axis of the power boat, illustrating the resulting air flow field into the vent.
Figure 8B:
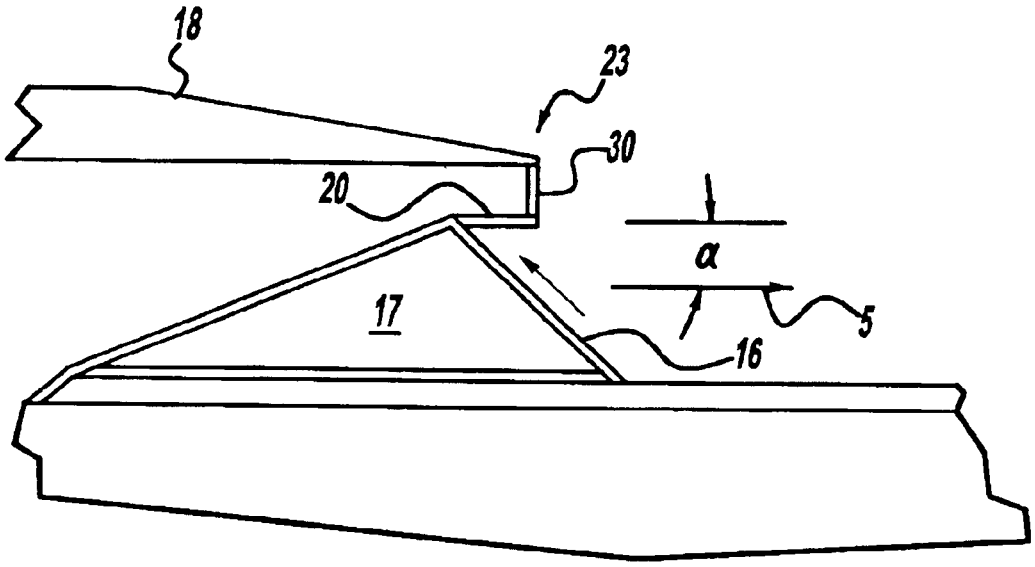
FIG. 8B is an enlarged partial side view of the power boat of FIG. 1 revealing the vent positioned at an angle parallel relative to the long axis of the power boat, illustrating the resulting air flow field into the vent.
Figure 8C:
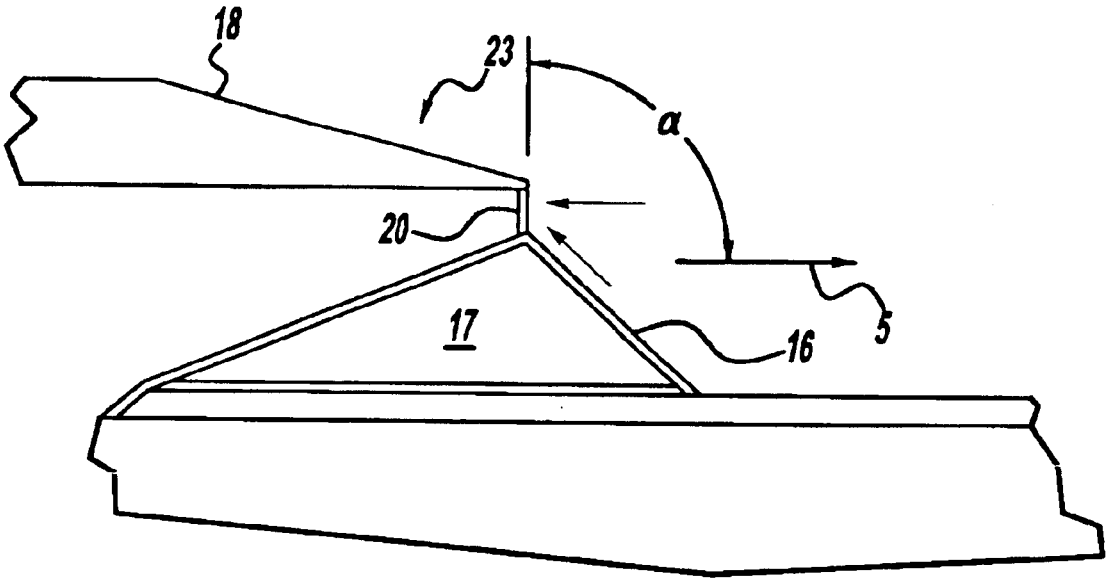
FIG. 8C is an enlarged partial side view of the power boat of FIG. 1 revealing the vent positioned at a right angle relative to the long axis of the power boat, illustrating the resulting air flow field into the vent.

Referring now FIGS. 8A through 8C, an enlarged partial side view of the power boat of FIG. 1 is shown, revealing the vent 20 positioned at various angles. Typically, a boat windshield is swept rearwardly, as such FIGS. 8A through 8C illustrate the angle α taken along the leading edge of the windshield 16, illustrating the angle α between the long axis 5 and surface of the vent 20. The position of the vent 20 relative to the long axis 5 of the boat 10 affects the airflow field. Although any angle α that provides airflow through the vent 20 may be employed in the present invention an angle α between about 0 and 90 degrees is preferred. By positioning the vent 20 at a suitable angle α relative to the long axis 5 of the power boat 10, ambient air is allowed to flow into the cockpit 13 of the boat 10.

The cockpit 13 of the power boat 10 is vented by spacing the cover engagement member 26 from the windshield engagement member 24, thereby forming an aperture 21 therebetween. The vent 20 is positioned at an angle α relative to the long axis 5 of the power boat 10, to allow ambient air to flow into the cockpit 13 of the boat 10.

Specifically, FIG. 8A discloses the vent 20 positioned at an acute angle α relative to the long axis of the power boat 10, illustrating the resulting air flow field into the vent 20. The position of the vent 20 allows for a flow field consisting of a mixture of air diverted by the windshield and air introduced directly into the vent 20.

FIG. 8B reveals the vent 20 positioned at an angle α parallel relative to the long axis of the power boat 10, illustrating the resulting air flow field into the vent 20. The position of the vent 20 allows for a flow field consisting substantially of air diverted by the windshield 16 to be introduced into the vent 20. This particular vent angle α minimizes the amount of water, insects and debris that can travel through vent 20. Furthermore a screen (not shown) may be employed to cover aperture 21, for preventing debris and insects from entering the cockpit 13. Furthermore the screen may be selectively removable by employing any suitable means known the art including, but not limited to, snaps, hook and loop type fastener devices, such as that sold under the trade mark VELCRO, zippers, threaded fasteners or selectively engageable retainers.

FIG. 8C reveals the vent 20 positioned at an angle α perpendicular relative to the long axis of the power boat 10, illustrating the resulting air flow field into the vent 20. The right angle position of the vent 20 allows for a flow field consisting substantially of air introduced directly into the vent 20.

EXAMPLE

Referring again to FIG. 1, in the present example, the frame 22 is securely attached to the top sill 15 of a two plate windshield 16. The canvas cover 18 is the original cover provided by the manufacturer, shown fastened to the cover engagement member 26 by snaps. Although snaps are the preferred method of attachment for the soft cover of the present example, as most manufactures employ snaps to secure soft covers in their production powerboats, suitable substitutes include zippers and hook and loop type fastener devices, such as that sold under the trade mark VELCRO. One of the advantages of the present invention is the minimal amount of time required to engage or disengage the vent 20 once the frame 22 has been installed. If the ventilation benefits of the present invention are not desired, the vent 20 may be disengaged by detaching the cover 18 from the cover engagement member 26 and attaching it to the windshield engagement member 24. Detaching and re-attaching the cover 18 takes only moments to complete. The windshield engagement member 24 also has snaps for receiving the cover to return the cover 18 to the original, non-ventilating, location. The cover 18 is then easily tightened by adjusting the rear stanchions of the frame 11.

In the present example, the frame 22 is sufficiently rigid so as to enable the boat 10 to be operated under design conditions without having the cover 18 attached to the cover engagement member 26. In the present example, experiments were performed on a boat 29 feet in length, having a windshield 7 feet in width. A 4 inch wide gap between the windshield engagement member 24 and cover engagement member 26 provided the desired level of ventilation in the cockpit 13 in the present example. By raising the front edge 19 of the cockpit cover 18, sufficient ventilation of the cockpit 13 may be achieved. One skilled in the art will immediately recognize that the present invention may be used with any size boat, irrespective of the beam, windshield width or length of the boat.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

It is claimed:

1. A cockpit vent for a power boat, the powerboat having a cockpit, a windshield and a cockpit cover, comprising:

a frame defining at least one aperture for introducing ambient air into the cockpit, said frame including a windshield engagement member and a cover engagement member, said frame disposed between the windshield and the cockpit cover;

said windshield engagement member attachable to a top sill of a boat windshield; and said cover engagement member spaced from said windshield engagement member, said cover engagement member being attachable to the cockpit cover.

2. The cockpit vent of claim 1, further comprising a pair of side members disposed between end portions of said windshield engagement member and cover engagement member, said side members interconnecting said windshield engagement member and cover engagement member.

3. The cockpit vent of claim 1, further comprising at least one support member disposed between said windshield engagement member and cover engagement member for rigidly supporting said frame.

4. The cockpit vent of claim 1, wherein said windshield engagement member generally follows the contour of the top sill of the windshield.

5. The cockpit vent of claim 1, wherein said cover engagement member generally follows the contour of a front edge of the cockpit cover.

6. The cockpit vent of claim 1, further comprising a cover engagement member adapter extending from said cover engagement member to the cockpit cover.

7. The cockpit vent of claim 1, further comprising a deflector inwardly extending from said cover engagement member of said vent, said deflector redirecting ambient air introduced through said vent.

8. The cockpit vent of claim 1, further comprising a selectively engageable air dam for halting the flow of ambient air introduced by the vent into the cockpit, said air dam extending between said windshield engagement member and one of said cover engagement member of a cover engagement member adapter, said adapter extending from said cover engagement member to the cockpit cover.

9. The cockpit vent of claim 1, further comprising a set of louvers for restricting the flow of ambient air introduced by the vent into the cockpit, said louvers extending between said windshield engagement member and one of said cover engagement member of a cover engagement member adapter, said adapter extending from said cover engagement member to the cockpit cover.

10. The cockpit vent of claim 9, wherein said louvers are selectively adjustable from an open position where airflow through said vent is maximized, to a closed position where airflow through said vent is halted.

11. The cockpit vent of claim 1, further comprising a diffuser for expanding the flow of ambient air introduced by the vent into the cockpit, said diffuser extending between said windshield engagement member and one of said cover engagement member or a cover engagement member adapter, said adapter extending from said cover engagement member to the cockpit cover.

12. The cockpit vent of claim 1, wherein said frame is a unitary member.

13. The cockpit vent of claim 1, wherein said frame is extruded.

14. The cockpit vent of claim 1, wherein said frame is formed of materials selected from the group consisting of aluminum, stainless steel and high-strength plastic.

15. The cockpit vent of claim 1, wherein said vent introduces ambient air deflected by the windshield.

16. The cockpit vent of claim 1, wherein, an angle between a long axis of the powerboat and the vent is between about 0 and 90 degrees.

17. The cockpit vent of claim 1, further comprising a screen covering at least one said aperture.

18. The cockpit vent of claim 17, wherein said screen is selectively removable.

19. A cockpit ventilation system for a power boat, comprising:

a windshield extending from a foredeck of the power boat;

a cockpit cover at least partially covering a cockpit;

a frame defining at least one aperture for introducing ambient air into the cockpit, said frame including a windshield engagement member and a cover engagement member, said frame disposed between said windshield and said cockpit cover;

said windshield engagement member attachable to a top sill of said windshield; and said cover engagement member spaced from said windshield engagement member, said cover engagement member being attachable to said cockpit cover.

20. The cockpit ventilation system of claim 19, further comprising a pair of side members disposed between end portions of said windshield engagement member and cover engagement member, said side members interconnecting said windshield engagement member and cover engagement member.

21. The cockpit ventilation system of claim 19, further comprising at least one support member disposed between said windshield engagement member and cover engagement member for rigidly supporting said frame.

22. A method of venting a cockpit for a power boat, the powerboat having a cockpit, a windshield and a cockpit cover, comprising:

spacing a cover support member from a windshield support member, the windshield support member attached to a top portion of the windshield, thereby forming a vent having at least one aperture therebetween;

positioning the vent at an angle relative to a long axis of the power boat to allow ambient air to flow into the cockpit of the boat.

* * * * *